United States Patent [19]

Carroll et al.

[11] Patent Number: 4,477,290

[45] Date of Patent: Oct. 16, 1984

[54] CLEANING AND ETCHING PROCESS FOR ALUMINUM CONTAINERS

[75] Inventors: James W. Carroll, Lafayette Hill; James E. Comstock, West Chester, both of Pa.

[73] Assignee: Pennwalt Corporation, Philadelphia, Pa.

[21] Appl. No.: 456,642

[22] Filed: Jan. 10, 1983

[51] Int. Cl.[3] ..... C23F 1/00; C23F 7/00; C23G 1/14

[52] U.S. Cl. ..... 148/6; 134/2; 134/29; 148/6.15 R; 156/665; 252/79.5; 252/156

[58] Field of Search ..... 134/2, 29; 252/79.5, 252/156, 135; 156/665; 148/6, 6.15 R

[56] References Cited

U.S. PATENT DOCUMENTS

| | | | |
|---|---|---|---|
| 2,584,017 | 1/1952 | Dvorkovitz et al. . | |
| 2,615,846 | 10/1952 | Dvorkovitz et al. . | |
| 2,795,490 | 6/1957 | Newman et al. . | |
| 2,795,491 | 6/1957 | Newman et al. . | |
| 2,836,526 | 5/1958 | Marosi . | |
| 2,839,370 | 6/1958 | Foulke et al. . | |
| 2,869,267 | 1/1959 | Holman . | |
| 3,314,890 | 4/1967 | Smith . | |
| 3,481,877 | 12/1969 | Moll | 252/79.5 |
| 3,557,000 | 1/1971 | Smith . | |
| 3,655,467 | 4/1972 | Sopp, Jr. | 252/156 |
| 3,681,140 | 8/1972 | Carlson . | |
| 3,802,973 | 4/1974 | Smith . | |
| 3,810,797 | 5/1974 | Schaffstall | 156/22 |
| 3,870,560 | 3/1975 | Shumaker | 134/2 |
| 3,898,095 | 8/1975 | Berdan et al. . | |
| 3,957,553 | 5/1976 | Smith . | |
| 4,028,205 | 6/1977 | Dorsey, Jr. . | |
| 4,091,954 | 5/1978 | Wallace . | |
| 4,094,701 | 6/1978 | Fekete | 134/2 |

FOREIGN PATENT DOCUMENTS

| | | | |
|---|---|---|---|
| 1117994 | 4/1966 | United Kingdom . | |
| 1097799 | 10/1966 | United Kingdom . | |
| 1420920 | 12/1971 | United Kingdom . | |
| 1383383 | 4/1972 | United Kingdom . | |
| 1505635 | 1/1977 | United Kingdom . | |
| 1552575 | 3/1978 | United Kingdom . | |
| 2067958 | 1/1981 | United Kingdom . | |
| 2102838 | 6/1981 | United Kingdom | 134/2 |

OTHER PUBLICATIONS

Wernick, S. and Pinner, R. *The Surface Treatment and Finishing of Aluminum and its Alloys,* Third Ed. Robert Draper Ltd., pp. 181–182, (1964).

Smith, H. V. and Carroll, J. W. *A Long-Lasting Aluminum Etching Bath,* 57th Annual Technical Conference, American Electroplater's Society, 6/22/70.

*Primary Examiner*—S. Leon Bashore
*Assistant Examiner*—K. M. Hastings

[57] ABSTRACT

Drawn and ironed (D & I) aluminum can bodies are prepared for conversion coating by cleaning and etching using a spray of a dilute aqueous solution of caustic and chelating agent at temperatures of up to about 130° F. The dilute aqueous alkaline solution consists essentially of from about 6 to 12 grams per liter of an alkali metal hydroxide and from about 3 to 6 grams per liter of a chelating agent. The cleaning and etching can be accomplished in a single step without smut formation.

9 Claims, No Drawings

CLEANING AND ETCHING PROCESS FOR ALUMINUM CONTAINERS

BACKGROUND OF THE INVENTION

This invention relates generally to the treatment of aluminum containers and more specifically to a process for cleaning oil and debris from the surfaces of such containers so that a conversion coating can be applied.

Aluminum containers used in the food and beverage industry are provided with a conversion coating of, for example, phosphorous, chromium, zirconium or titanium salts which prevents the staining of the aluminum during the pasturization of beer or other food stuffs. The coating also aids in the adhesion of organic coating materials to the containers. A satisfactory conversion coating process requires that any dirt and lubricants be removed from the surface of the aluminum. In the container forming process known as drawing and ironing, fine particles of aluminum and other debris are pressed into the surface when the aluminum is formed into a can body. These particles and debris must also be removed from the surface. In the past, alkaline cleaners and etchants were tried and abandoned due to scale formation in the equipment, fluctuations in etch rate giving poor appearance and even leaks, and chemical contamination due to high levels of dissolved aluminum. Consequently, acid etching and cleaning are usually employed. The acid etchants include hydrofluoric acid. Although giving good results and producing the mirror-bright can surfaces which are preferred by the beverage manufacturers, the use of hydrofluoric acid presents a safety and effluent disposal problem and requires stainless steel equipment. An alkaline cleaning process for aluminum containers is disclosed in U.S. Pat. No. 4,091,954 which process employes 3 to 5% tetrasodium pyrophosphate, 0.1 to 0.2% sodium gluconate, and 0.1 to 2% of wetting agent. However, cleaning temperatures of 160°–180° F. are disclosed and the presence of wetting agent in the composition would be expected to create foaming which is undesirable.

We have discovered a low-temperature alkaline cleaning and etching process for aluminum containers using alkali metal hydroxides which cuts cleaning costs, alleviates the safety and effluent problems and reduces the amount of rinse water needed. At the same time, the process avoids the problems associated with previous alkaline etch processes. Bright can surfaces are produced which can be conversion coated without further processing. This is surprising in view of the fact that other aluminum cleaning processes, such as the immersion cleaning of lithographic plates, using similar alkali metal hydroxide etch solutions used in other aluminum cleaning operations require a subsequent desmutting step.

BRIEF SUMMARY OF THE INVENTION

In accordance with this invention there is provided a process for cleaning and etching the surface of an aluminum container comprising spraying the surface with a dilute aqueous alkaline solution which includes an alkali metal hydroxide and a chelating agent at an elevated temperature so as to form a clean, bright surface. A uniform conversion coating on the container surface can then be formed using either an acid or an alkaline conversion coating solution.

DETAILED DESCRIPTION

The aqueous cleaning and etching solutions useful in the process of the invention include alkali metal hydroxides such as sodium and potassium hydroxides in concentrations from about 6 to 12 grams per liter of water. Solutions having these alkali concentrations in combination with chelating agents when used to spray clean aluminum containers at the proper conditions of time and temperature, are of sufficient strength to provide good cleaning and fines removal while avoiding overetching the surface to a dull finish and/or the smut formation which usually occurs when using alkali metal hydroxide etch processes for aluminum. The solutions have a pH of about 13.

Chelating agents are included in the solution to supress the precipitation of aluminum which builds up in the solution during use. Suitable chelating agents include, for example, sorbitol, gluconic acid, glucoheptoic acid, mannitol, ascorbic acid, sorbose, tannic acid, ethylenediamine tetraacetic acid, sodium chrome gluocosate, diglycolic acid, picolinic acid, aspartic acid, dithiooxamide, d-gluconolactone, and l-rhamnose. The chelating agents are used at concentrations of about 3 to 6 grams per liter of solution. These amounts of chelating agents are relatively high in proportion to the alkali concentrations. At these concentrations, the agents not only hold the aluminum in solution in the comparatively dilute alkaline etch baths but the agents also serve to control the etch rate so as to produce clean, bright surfaces.

No other ingredients, such as cleaning or wetting agents, are required. This is an advantage because the wetting agents which are normally used to aid in removing dirt and oil cause foaming. However, low foaming surfactants could be employed for certain applications.

The cleaning solutions are effective to clean the aluminum container surfaces at relatively low temperatures of from about 80° to 130° F. The temperature must be high enough to clean the surface but not so high as to cause overetching at the particular alkali metal hydroxide concentration used in the etch bath. The cleaning is accompanied by spraying the solution onto the surfaces to be cleaned. Cleaning by immersion would result in overetching and smut formation. Spray times of from about 30 to 60 seconds and pressures of from about 10 to 40 psi are adequate for the process. The relatively low temperatures of the cleaning process provide good energy economy.

If desired, a pre-cleaning step can be employed using an uninhibited alkaline or acidic cleaning bath. However, the process does not require a pre-cleaning step and so the process avoids the need to add additional cleaning equipment where such equipment is not already available. A suitable pre-cleaning solution can be derived from the overflow of the cleaning and etchant solution to provide an alkali metal hydroxide concentration of from about 0.1 to 3 grams per liter.

Another suitable uninhibited, mildy etching alkaline cleaner which has been found useful is based on a dilute solution of tetrapotassium pyrophosphate, sodium gluconate, and soda ash. For example, a concentrate of 84% by weight water, 6.0% by weight tetrapotassium pyrophosphate, 5.0% by weight sodium gluconate and 5.0% weight soda ash is made up and then diluted to a suitable working strength of from about 1.0 to 3.0% by volume. This provides working concentrations of from about 0.6 to 2.0 grams per liter of tetrapotassium pyrophosphate, from about 0.5 to 1.8 grams per liter of sodium gluconate and from about 0.5 to 1.8 grams per liter of soda ash. Again, no wetting agent is used or needed in this solution so that foaming is minimized.

Following the cleaning and etching step, the aluminum containers are rinsed in cold water to remove the etchant and are then ready for conversion coating. The conversion coating is usually made up of a layer of water insoluble salts which provide protection against discoloration during pasturization and other heating processes. The coating also provides adhesion of paints and lacquers to the container surface. The conversion coatings can be applied from either acidic or alkaline solutions. One type of acidic solution contains chromic acid, phosphoric acid, and hydrofluoric acid. Because of effluent problems associated with hexavalent chromium, acidic solutions containing zirconium and/or titanium with fluoride have been developed. Alkaline conversion coatings which do not include heavy metal ions can also be used. These solutions are based on a combination of alkali metal silicates and organic polymers.

The invention is further illustrated by, but is not intended to be limited to, the following examples wherein parts are parts by weight unless otherwise indicated.

EXAMPLE 1

Drawn and ironed aluminum can bodies were prerinsed in cold water and then spray cleaned according to the process of the invention in a pilot line can cleaning operation with an alkali cleaning and etching solution at a temperature of 120° F. and a spray pressure of 10 psi for about 45 seconds. The cans were then rinsed for about 45 seconds with water. The cleaning solution was prepared by making up a 1.65% by volume aqueous solution from an aqueous concentrate containing 68.0% by weight of 50% by weight caustic soda (NaOH) and 32.0% by weight of 50% by weight of the chelating agent, gluconic acid. This cleaning solution contained about 7.2 grams per liter of NaOH and 4.2 grams per liter of sodium gluconate. Excellent cleaning was obtained with complete fines removal from the cans. The surface was bright, but not a mirror finish. In another run using a 1.0% by volume (4.5 grams per liter NaOH) cleaning solution, fines removal was incomplete. Excellent results were obtained, however, in laboratory tests using the same solution but at a concentration of 1.5% by volume at temperature of from 100°–120° F. using spray times of 45 to 60 seconds.

EXAMPLE 2

Drawn and ironed aluminum cans were pre-cleaned using a 1.0% by volume aqueous solution made up from a concentrate of, by weight, 84% water, 6.0% tetrapotassium pyrophosphate, 5.0% sodium gluconate, and 5.0% soda ash. The spray pressure was 35 psi and temperature 130° F. The cans were rinsed in water to remove the pre-cleaning solution and then cleaned and etched at a spray pressure of 10 psi for 45 seconds in solutions made up from the concentrate of Example 1 at the concentrations and temperatures listed in Table 1 below. Following etching, the cans were rinsed with water.

TABLE I

| Test Number | Volume Concentration | Temperature | Result |
|---|---|---|---|
| 2-A | 0.82% | 130° F. | white stain on dome, incomplete etching |
| 2-B | 1.65% | 130° F. | white stain on dome, complete fines removal |
| 2-C | 1.65% | 120° F. | bright surface, complete fines removal |
| 2-D* | 1.65% | 110° F. | bright surface, complete fines removal |
| 2-E** | 1.65% | 80° F. | bright surface, complete fines removal |
| 2-F*** | 1.65% | 75–80° F. | very slight smut |
| 2-G | 1.50% | 90° F. | white stain on dome, no smut |
| 2-H | 1.50% | 80° F. | bright surface, very slight fines |

*At etching spray pressures of 10 and 35–40 psi
**Pre-cleaned at 145° F.
***Pre-cleaned at 160° F.

Test Number 2-A at a concentration of only 3.7 grams per liter of NaOH gave incomplete cleaning. Test runs at pre-cleaning concentrations of 1½ and 2 percent by volume at 130° F. and a cleaning concentration of 1.65% at 80° F. gave excellent results.

Cans which were cleaned and etched by the process of the invention will accept conversion coatings. A non-chromated aqueous coating bath which was used for this determination included zirconium carbonate, 0.27 grams per liter; nitric acid, 0.25 grams per liter; monosodium phosphate, 0.45 grams per liter; hydrofluoric acid, 0.11 grams per liter; and sodium gluconate, 0.1 grams per liter. The bath is used at a temperature of 100° F. for 30 seconds.

The foregoing has described a process for cleaning and etching aluminum cans which avoids the need for a hydrofluoric acid etch. The process removes residual lubricant and aluminum fines while providing a sufficient etch to the metal to improve coating adhesion while maintaining adequate can brightness. The cleaning and etching can be accomplished in a single step without smut formation.

We claim:

1. A process for cleaning and etching the surface of an aluminum container comprising spraying the surface with a dilute aqueous alkaline solution consisting essentially of from about 6 to 12 grams per liter of an alkali metal hydroxide and from about 3 to 6 grams per liter of a chelating agent at an elevated temperature from about 80° to 130° F. so as to form a clean, bright surface without desmutting.

2. The process of claim 1 wherein the temperature of the solution ranges of from about 100°–120° F.

3. The process of claim 1 wherein the surface is sprayed with a solution for from about 30 to 60 seconds at a spray pressure of from about 10 to 40 psi.

4. The process of claim 1 including the step of precleaning the container before cleaning and etching.

5. The process of claim 4 wherein the container is pre-cleaned in a spray of an uninhibited alkaline precleaning bath.

6. The process of claim 5 wherein the alkaline precleaning bath is an aqueous solution including an alkali metal hydroxide at concentration of from about 0.1 to 3 grams per liter.

7. The process of claim 5 wherein the alkaline precleaning bath includes from about 0.6 to 2.0 grams per liter of tetra potassium pyrophosphate, from about 0.5 to 1.8 grams per liter of sodium gluconate and from about 0.5 to 1.8 grams per liter of soda ash in water.

8. The process of claim 1 including the steps of forming a conversion coating on the cleaned and etched surface.

9. The process of claim 1 wherein the chelating agent is selected from gluconic acid, glucoheptoic acid, and sorbitol.

* * * * *